US007322109B2

(12) United States Patent
Newkirk et al.

(10) Patent No.: US 7,322,109 B2
(45) Date of Patent: Jan. 29, 2008

(54) RAZOR FOR BUZZ CUTTING HEAD HAIR

(75) Inventors: James C. Newkirk, 2324 Willow La. #93, Crescent Springs, KY (US) 41017; Donna M. Newkirk, 2324 Willow La. #93, Crescent Springs, KY (US) 41017

(73) Assignees: James C. Newkirk, Crescent Springs, KY (US); Donna M. Newkirk, Crescent Springs, KY (US)

( * ) Notice: Subject to any disclaimer, the term of this patent is extended or adjusted under 35 U.S.C. 154(b) by 165 days.

(21) Appl. No.: 10/886,090

(22) Filed: Jul. 7, 2004

(65) Prior Publication Data

US 2006/0005394 A1 Jan. 12, 2006

(51) Int. Cl.
*B26B 21/42* (2006.01)
*B26B 21/14* (2006.01)

(52) U.S. Cl. ..... 30/50; 30/30

(58) Field of Classification Search ..... 30/48, 30/50, 30, 31, 34.2, 77, 78, 81, 82
See application file for complete search history.

(56) References Cited

U.S. PATENT DOCUMENTS 1,976,290 A * 10/1934 Motley ..... 30/30
2,034,262 A * 3/1936 Marrazzo ..... 30/30
2,514,774 A * 7/1950 Leedy ..... 30/30
D159,994 S * 9/1950 Lee ..... D28/52
2,530,917 A * 11/1950 Taylor ..... 30/30
2,634,496 A * 4/1953 Halen ..... 30/30
3,183,589 A * 5/1965 Szabo ..... 30/30
3,263,330 A * 8/1966 Ferrara ..... 30/346.56
4,030,193 A * 6/1977 Mandilaras ..... 30/30
4,037,322 A * 7/1977 Bresler ..... 30/53
4,441,252 A * 4/1984 Caves ..... 30/30
4,535,537 A * 8/1985 Ferraro et al. ..... 30/32
5,386,750 A * 2/1995 Morrison ..... 83/13
5,979,056 A * 11/1999 Andrews ..... 30/49
6,058,608 A * 5/2000 Wruck ..... 30/289

* cited by examiner

*Primary Examiner*—Hwei-Siu C. Payer
(74) *Attorney, Agent, or Firm*—Wood, Herron & Evans, L.L.P.

(57) ABSTRACT

A dual wet razor device is used for shaving hair on a head at different lengths. The device has a first and a second cutting edge on opposite sides of one another and a sensitive guide under each cutting edge for safely cutting different short lengths of hair on the scalp of a user.

2 Claims, 2 Drawing Sheets

RAZOR FOR BUZZ CUTTING HEAD HAIR

FIELD OF THE INVENTION

This invention relates to a head shaving razor and, in particular, to a razor designed for wet shaving of hair close to the scalp thereby leaving a predetermined length of hair on ones head.

BACKGROUND OF THE INVENTION

It has been common practice to trim hair on the scalp and obtain what has been commonly referred to as a "buzz cut" with an electric clipper. The buzz cut refers to very short or stubbled hair length on the head. Different attachments have been employed with the electric clipper in order to leave a short length of hair at a predetermined distance from the scalp. More recently, individuals are interested in conveniently shaving their own head in order to obtain the clean head-shaved hair appearance rather than going to a salon or barber shop. Individuals thereby save money and are able to always appear well groomed with a length of hair which they may desire.

Thus, there has been a need for some simple and relatively inexpensive razor for enabling an individual to easily and safely wet shave his own head hair. Such a device is especially desired for safely wet shaving head hair while showering. It would also be advantageous to have a wet shave razor which is versatile for hair cutting at different lengths.

SUMMARY OF THE INVENTION

This invention is directed to a razor which enables an individual to wet shave his own head at a predetermined length of hair. This invention provides a razor which is versatile in facilitating shaving of head hair to obtain a buzz cut of different lengths with one razor device.

The dual wet razor device is especially designed for an individual to safely shave the hair on his head very close to the scalp.

The razor can be used in the shower by applying shaving gel and shaving the head thereby enabling an individual to cut his own hair and keep the haircut well groomed at all times.

The dual wet razor device of this invention has a handle and a shaving head disposed at the end of the handle. The shaving head is adapted to hold a razor blade having a first and a second cutting edge which are disposed opposite one another. Each cutting edge is protected by a sensitive guide which separates the cutting edge from scalp and determines the cut length of hair. The first razor cutting edge is disposed by the guide at a distance of, for example, ⅛ of an inch to provide a cut length of hair. The second cutting edge is spaced from the guide at a greater distance, for example, to provide a ¼ inch haircut. Accordingly, the differently spaced cutting edges enable the dual versatile razor for shaving the hair on the scalp at two distinct lengths depending upon the desire of the user.

The sensitive guides are mounted on the razor head and positioned outwardly from the blade to determine the length of the hair exposed to each cutting edge of the razor blade so as to leave hair on the scalp at a predetermined distance. In a preferred form, the sensitive guide is formed by a plurality of rounded knobs which cooperate with the cutting blade so as to provide a smooth, clean and safe haircut. Thus, the dual razor avoids cutting abnormalities on the scalp, such as moles, scars or folds in the skin, and the like. These rounded guides will also raise the hair just by their movement on the scalp and will feed the hair to the blade for cutting. Other forms of guides may be used to provide the same results.

These and other objectives of this invention are accomplished by a razor device having a single head and a razor blade having two opposite cutting edges mounted on one end of a single handle. The razor head is provided with sensitive guides disposed adjacent to and outwardly from each cutting edge such that the cutting edges face in opposite directions for cutting different lengths of hair on the scalp. The user thus employs a single razor having one cutting blade and two different cutting edges which the user may select for obtaining different hair lengths of a buzz cut on his scalp by simply rotating the handle of the razor.

The benefits and advantages of this invention will be further understood with reference to the drawings and detailed description.

DETAILED DESCRIPTION AND PREFERRED EMBODIMENT

Figure 1:
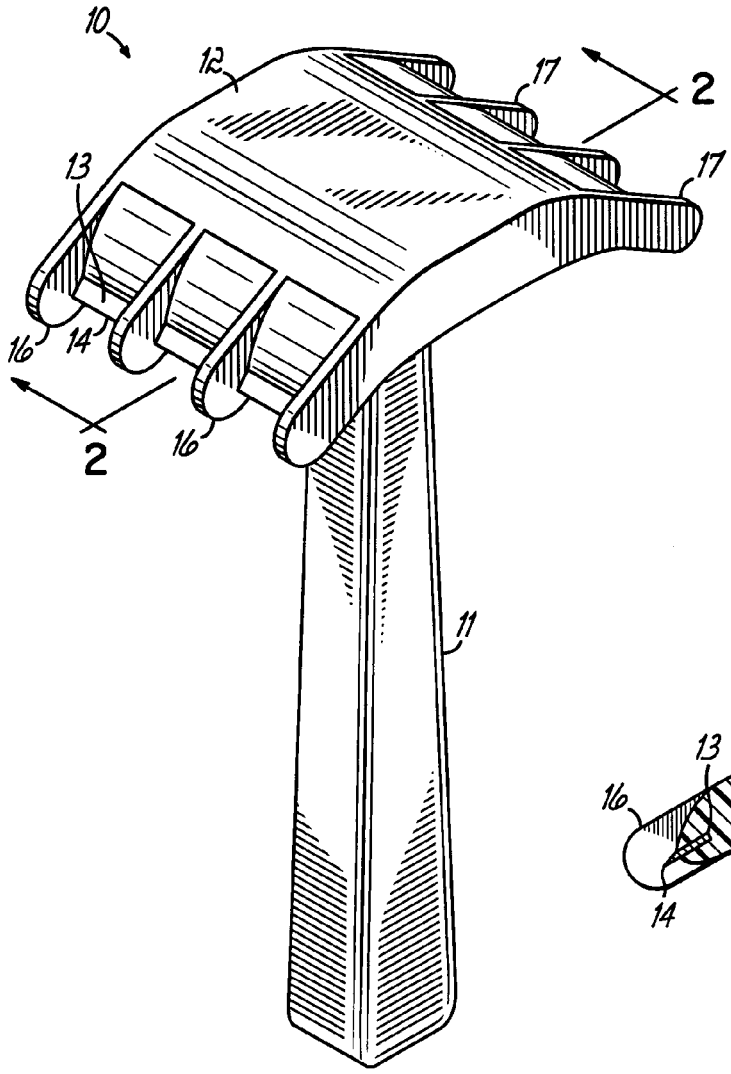
FIG. 1 is a perspective view of a razor device according to the invention.
Figure 2:
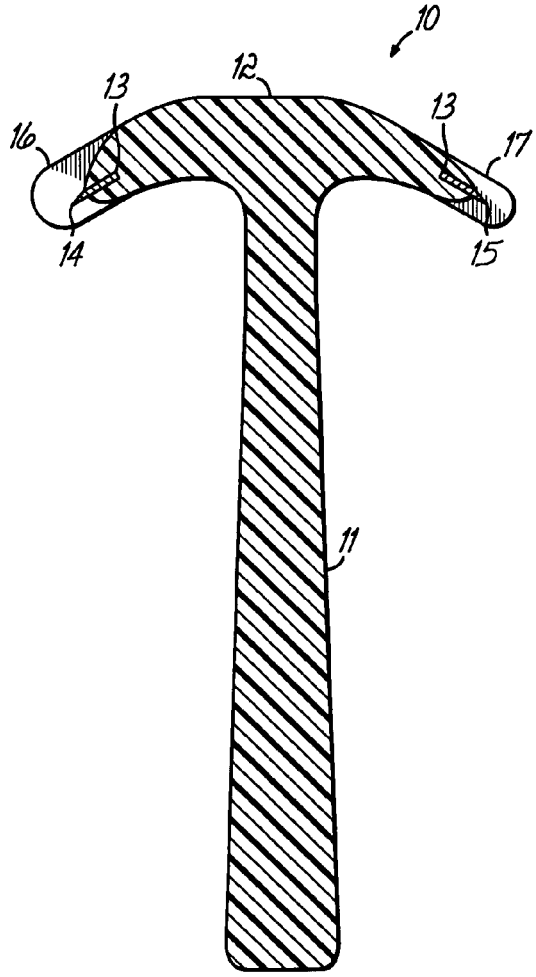
FIG. 2 is a cross sectional view of the razor device taken along line 2-2 of FIG. 1 illustrating the razor head, blade cutting edge and guides which illustrates sensitive guides of different lengths on opposite sides of the razor head adjacent to each cutting edge.
Figure 3:
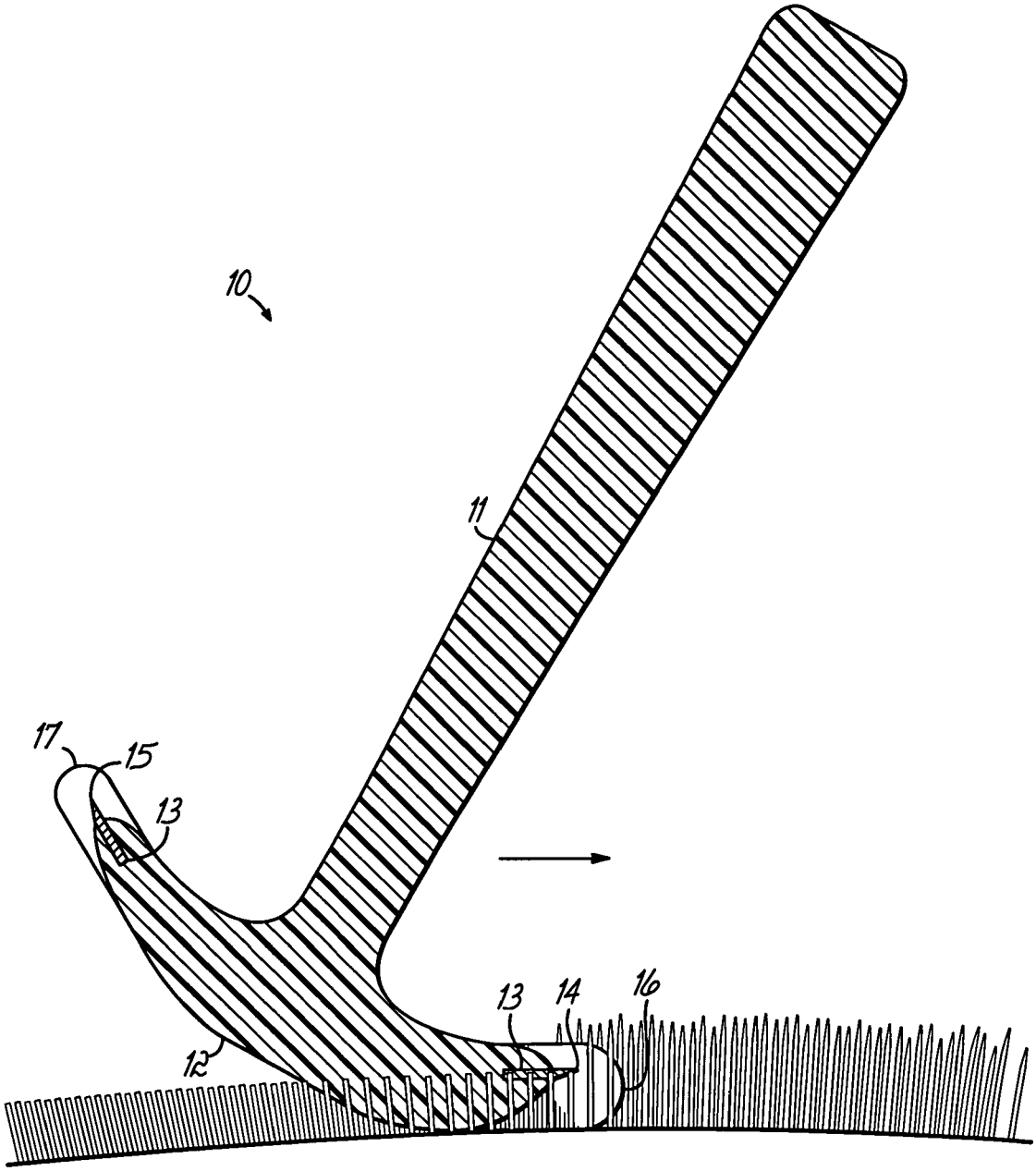
FIG. 3 is a cross sectional view of the razor device according to the invention, similar to the view of FIG. 2, showing the razor device in use.

A wet buzz cut razor device 10 of the invention as shown in FIGS. 1-3 has an elongated handle 11 and a razor head 12 attached to the handle at one end. The razor head 12 is adapted to hold one or more razor blades 13 to form a first cutting edge 14 and a second cutting edge 15 which are on opposite sides of the head 12. The first and second cutting edges 14, 15 are positioned such that the razor head 12 may simply be rotated 180° to provide a razor head having the ability to shave hair at different lengths on the scalp.

The razor head 12 also supports sensitive guides 16, 17 which extend outwardly from each cutting edge of the razor blade 13. As shown, the sensitive guides 16, 17 are of different sizes so as to dispose each cutting edge 14, 15 at a predetermined distance from the scalp for cutting the hair at different lengths. In a preferred form, the sensitive guides 16, 17 are designed such that no sharp edges are presented to the scalp such as those shown as knobs having a rounded shape. In a preferred form, a plurality of sensitive guides 16, 17 are employed on each opposite side of the razor head 12. At least one knob is on each end of a cutting edge and one is in the center. In the most preferred form, the guides 16, 17 extend outwardly from and above the cutting blade edge 14, 15 so that the blade is disposed at an angle to the scalp for efficiently cutting the hair as shown in FIG. 3. For example, the sensitive guides 16, 17 are disposed at distances for leaving ⅛ inch long hair (guides 17) on the scalp or ¼ inch long hair (guides 16) on the scalp. The sensitive guides 16, 17 tend to raise the hair just by movement on the scalp and will feed the hair to the blade 13 for cutting.

The dual razor device of FIGS. 1-3 according to the invention is used in a conventional manner. Usually the hair has been cut short and the person wishes to return it to a buzz cut length. For instance, the razor may be used in the shower by applying a shaving gel to the scalp and the head may be shaved by cutting to the desired length with the single razor head. After applying a shaving gel, the user simply elects either the long or short hair cutting edge in order to shave the hair. This may be achieved by simply employing the short or long hair cutting edge by rotating the handle of the razor device. Accordingly, the short cutting edge can be applied for precise shaving of the hair stubble close to the scalp. Alternatively, the user can select either cutting edge by simple rotation of the handle to achieve different lengths of hair remaining on the scalp in different areas, depending upon the desire of the user.

The dual razor device may be designed for disposable use by fabrication with a plastic material, as razor heads are known in the art, in an inexpensive manner so that the razor may discarded. On the other hand, the razor device may be fabricated with a permanent handle and head such that the blade is removable so that it may be discarded and replaced when the blade becomes dull. Of course, more than one blade may be mounted on the razor head on opposite sides of the head to achieve the objectives of this invention and thereby replacing a single blade having different cutting edges. It is preferred for cost savings to employ one blade having a cutting edge on each side.

Those in the art should appreciate that the razor device of the present invention is not limited to the particular construction disclosed and are shown in the drawings. Instead, the present invention also encompasses any modifications or equivalents that would be understood to a person of skill in the art to achieve the objectives of this invention in view of the above description.

What is claimed is:

1. A dual wet razor device for shaving hair on a head scalp at different lengths comprising:

a handle having a disposable plastic razor head disposed at one end, first and second razor blade edges each mounted on opposite sides of said head, said razor head having a sensitive guide integrally formed therewith as one single piece and extending outwardly on the opposite sides of said head beyond said first and second razor blade edges, said sensitive guide comprising a plurality of rounded knobs each knob having a semicircular front continuously extending above and below the razor blade edge, said rounded knobs defining the outermost portions of the plastic razor head and sized for disposing said first and second razor blade edges at different predetermined distances from said head scalp to leave ⅛-inch long hair and ¼-inch long hair, respectively, on said scalp, by selectively wet shaving the hair on the head scalp with either said first or second razor blade edge, said rounded knobs for facilitating movement of the razor head across the head scalp for safely cutting the hair.

2. The dual wet razor device of claim 1 wherein said handle is elongated for gripping by a user's hand and the razor head is disposed at one end of the handle such that rotation of said handle enables the user to cut hair with either of said first or second razor blade edges.

* * * * *